US005976642A

United States Patent [19]

Yang

[11] Patent Number: 5,976,642

[45] Date of Patent: Nov. 2, 1999

[54] STEREO CERAMIC GRANITE AND MARBLE

[76] Inventor: Dening Yang, Room 503, Bldg. 1, No. 2, Fuxian St., Foshan City 528000, China

[21] Appl. No.: 08/832,346

[22] Filed: Apr. 2, 1997

[30] Foreign Application Priority Data

Apr. 2, 1996 [CN] China ..... 96 1 03804-7

[51] Int. Cl.[6] ..... B44F 9/04

[52] U.S. Cl. ..... 428/15; 428/49; 428/325

[58] Field of Search ..... 428/15, 49, 325

[56] References Cited

U.S. PATENT DOCUMENTS

| | | | |
|---|---|---|---|
| 4,818,731 | 4/1989 | Mizutani et al. | 428/15 X |
| 5,403,631 | 4/1995 | Sato et al. | 428/15 |
| 5,403,664 | 4/1995 | Kurahashi et al. | 428/15 X |

FOREIGN PATENT DOCUMENTS

| | | |
|---|---|---|
| 85102535 | 1/1987 | China . |
| 86108043 | 6/1988 | China . |
| 88100494 | 12/1988 | China . |

*Primary Examiner*—Henry F. Epstein

*Attorney, Agent, or Firm*—Sughrue, Mion, Zinn, Macpeak & Seas, PLLC

[57] ABSTRACT

A stereo ceramic granite and marble has a stereo pattern composed of more than two non-transparent silicate color masses containing more than 20% non-vitrified state composition. As seen from its vertical section, it has the characteristics that wherein both vertical sectional edges of at least four mutually contacting color masses are essentially parallel to the extension lines of the boundary lines of the other color masses from within 3 mm beginning form the surface of the product and form an angle of 10° to 170° with the surface plane of the product, the deviation error of parallelism not exceeding 40°, and this kind of pattern exists in the product at more than four places.

16 Claims, 5 Drawing Sheets

STEREO CERAMIC GRANITE AND MARBLE

FIELD OF THE INVENTION

The present invention relates to stereo ceramic granite and marble used as decorative material, and more particularly, to a novel decorative material used as decorative panel for the ground, walls and furniture.

DESCRIPTION OF RELATED ART

Of the prior art vitrified ceramic tiles, one is a mono-colored or granular (granule within 20 meshes), mixed colored vitrified ceramic tile, but it has such limitations as monotony of color tone, lack of pattern, and limited applications. The other is a vitrified ceramic tile, for example, a kaleidoscopic tile, the pattern of which is made by screening in separate times and separate colors using a sieve. As powder of different color pigments is screened twice or several times into different locations of the lower frame of the die-molding mold frame, forming a multiple accumulation of free falling bodies, the boundary between two color regions forms with inwards non-parallel slanting line, the contacting edges of the two color regions intertwine and mingle with each other in confusion, the pattern being rough and crude, so that it can not be made into exquisite ceramic tiles. Since the pattern is not so fine and clear as slab of natural stone and colored glazed tile, stereo patterns can by no means be made, let alone exquisite and complicated ones. The third is a vitrified tile made by silk-screen printing, non-silicate penetrating color pigments technology. During the manufacturing process, the penetrating color pigments flow through the microgap of the color pigments powder material of the vitrified tile and partly mix with it, therefore, the color of the pattern of this product is neither clear nor bright, unable to present the decorative effect of real stone, so limiting the scope of application. This penetrating color pigments flowing into the microgaps of the vitrified granules of the powder material after being sintered form a colored mass, which is different in structure from the colored mass formed by sintering a ceramic powder containing coloring elements, therefore, it is not possible for it to form a bright colored composite pattern. The fourth is a vitrified ceramic tile, on which the granular pattern is formed by means of granulator. The shapes of the granules are mostly circular or conical, being stiff, awkward and unnatural, unable to form a decorative pattern as natural as that of the slab of natural stone, and so it cannot be formed with a massive panel pattern as in the case of marble. The fifth employs the terrace die technology of the press mold to provide the surface of the product with striped of dotted depressions during the formation stage. It is sprayed with liquid glass before sintering, so that after sintering the product would exhibit a transparent pattern or of any other color, where the liquid glass remains. However, these portions are all vitrified in composition, containing no non-vitrified high temperature ceramic material, no compositions of crystalline state. Thus the product is poor in hardness and abrasion resistance. It can only partly coordinate in the pattern. At the juncture, it is very stilt and awkward just like being cut by a knife. It is different from the structure of the tile body of the present invention which contains more than 20% non-vitrified tile body composition. The sixth is the existent brocatel tile, on which although various patterns can be formed, it is merely a very thin layer and can not be ground and burnished to become a polished tile as smooth as a mirror, because once it is ground to be smooth, the pattern on the surface is mostly ground off, failing to form a pattern. If it is not ground to be smooth, it would not possess the noble feel of a polished tile. Moreover, the brocatel tile is not wear-resistant enough in use and is therefore limited in use and service life.

In summary, the prior art ceramic tiles has various defects as stated above, they can not take account of the thickness of the wear-resistant layer, and the exquisite and smooth pattern, the decoration effect of bright color and the characteristic of abrasion resistance at the same time.

SUMMARY OF THE INVENTION

For the above reasons, the object of the invention is to provide a vitrified tile of stereo imitation stone-slab pattern in which the above-mentioned shortcomings of the prior arts have been overcome.

To achieve this object, the product of the present invention is characterized in that the pattern formed by sintering two, three or more than three kinds of silicate ceramic granules which are of different opaque colors and contain more than 20% non-vitrified state composition, is apparently different from the granule pattern formed by means of granulator technology and from the pattern formed by the technology of multiple distributions of powder through sieve as well as from the pattern formed by penetrating color pigments structure of non-silicate composition. That is to say, in the microscopic view, it presents a plurality of boundary lines at the juncture of colored masses comprised of non-vitrified and vitrified state ceramic granules of different meshes, more than 15 mm long each, the boundary lines being essentially straight lines, at least three boundary line extending on the product plane to the edge of the product, wherein there are at least four colored masses connected to each other, in the vertical section view, the boundary lines of each of the color masses extend parallel within the upper 75% portion from the surface of the product, and form an angle of 10° to 170° in respect to the surface plane of the product, the deviation error of parallelism less than 40°, or is nearly perpendicular the surface of the product with the deviation error less than 20° and this kind of pattern exists in the product at more than four places.

Owing to the novelty in the manufacturing process of the stereo pattern according to the present invention and the three-dimensional geometrical structure of the boundaries among different color regions after sintering of the colored silicate ceramic granules, besides the advantages of wear-resistance, contamination resistance, high strength, abradability to become a polished plane, aesthetic appearance and smoothness, the polished plane pattern of the composite colored ceramic material of the product according to the present invention has a thickness of 0.5 mm to 1000 mm and has an abrasion-resistant layer just as the natural granite. Therefore, when a certain thickness is abraded off, the plane pattern of the product will not be changed.

The inventiveness and practical applicability of the present invention reside also in that the pattern of the product can be made arbitrarily according to the patterns of natural granite and marble and imitated to the degree of looking genuine. Moreover, it can overcome such disadvantages among natural stone slabs, as big color aberration, non-consistence of quality, higher water absorption rate, poor freezing resistance and containing such harmful radioactive substance as argon, especially when used in exterior walls and ground. The existent natural stone slab has the disadvantage of inconsistency of color aberration, thus look very awkward during wet seasons as well as the alternation of dry and wet surroundings between fine and rainy days.

This is a problem not easy to solve. However, the present invention solves very well this difficult technical problem. The polished vitrified tile with an imitation marble pattern of the present invention has higher acid resistance, fouling resistance, wear resistance, hardness, strength, better flatness and smoothness than such limestone as natural marble and contains no radioactive contamination substances and harmful gases, and has better practical applicability than natural stone slab. As compared with other stone slabs, the product of the present invention is more suitable to be used as wall face and ground face materials both indoors and outdoors. Compared to the existent products of the same category, the product of the present invention has the composite advantages of better decorative capability and better durability, freezing resistance, fouling resistance, corrosion resistance, and wear-resistance.

As, according to the present invention, there have been distributed pigments of various color over many regions and points, so it can be formed with two to more than hundreds of colors, such as red, yellow, blue, white, black, green, and the like; ceramic colors having various metallic luster, such as, red, yellow, green, gray, blue, silvery white and the like; and pretty glazing colors of color glazed tiles, such as red, yellow, green, gray, blue, white and crystalline glaze color; and colors made by mixing the above-mentioned various glazing colors; and also with transparent glazes. Richness and abundance of colors in the present invention is many times superior than the existent vitrified tiles, the reason therefor being that if a colored glaze of low melting point is used in the existent vitrified tile technology, the colored glazes formed on the surface of the product would stream down in the kiln due to high temperature, damaging the equipment, affecting the production, and causing the product to become deformed, whereas the technology according to the present invention distributes a plurality of color points or regions simultaneously over the surface of the product. Since they contain more than 20%, or even 40%, 55%, 60%, 70%, 80% non-vitrified ceramic material, the shape of the product can be guaranteed and so is the richness of its color effect.

BRIEF DESCRIPTION OF THE DRAWINGS

The following is a description of the embodiments of the present invention with reference to the accompanying drawings, in which.

DETAILED DESCRIPTION OF THE PREFERRED EMBODIMENTS

Figure 1:
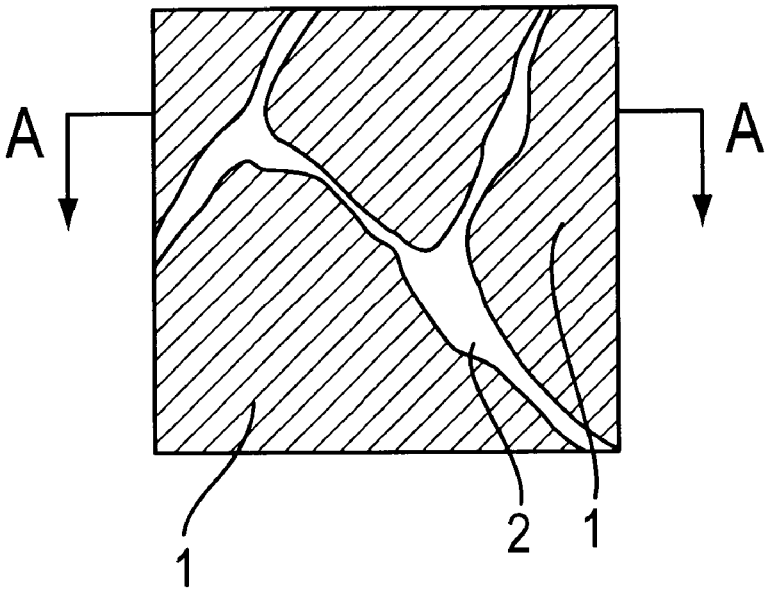
FIG. 1 is a plan view of the stereo ceramic granite and marble vitrified tile of the first embodiment of the present invention.
Figure 2:
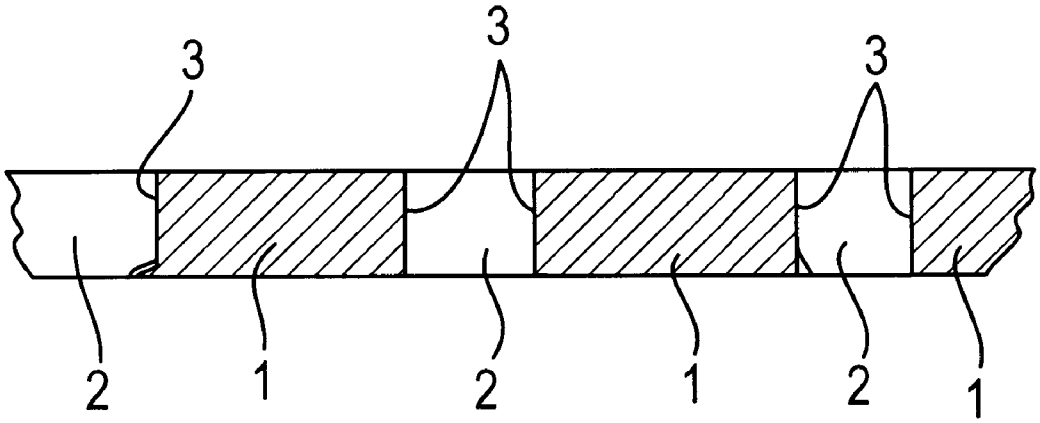
FIG. 2 is a vertical sectional (A—A) view of the first embodiment of the present invention of FIG. 1.

FIG. 1 shows the plan view of a piece of 300 mm×300 mm stereo ceramic granite and marble vitrified tile of the first embodiment of the invention, in which the slanting (shade) line portion 1 denotes green vitrified mass (containing more than 20% non-vitrified ceramic material of high melting point) and white colored portion 2 denotes grayish white vitrified mass (containing 30% crystalline ceramic material and 20% non-vitrified state ceramic material of high melting point). They constitute the dark green marble veined pattern. It can be seen from FIG. 2 that on whichever symmetrical combination faces of the colored masses, the 75% fore boundary lines 3 of the dark green vitrified mass and the grayish white vitrified mass are nearly parallel, and the errors of the parallelism between the two nearly perpendicular lines are all less than an angle of 40°. The manufacturing process of the product of the first embodiment of the present invention is as follows: mixing dark green powdered material and grayish white powdered material, suitable for the vitrified tiles of the sintering temperature of 1220° C., respectively, with diluents to provide a paste or half-dried powder, which is charged separately to two containers; placing specially shaped die orifices of two sets of built-up mold on the frame opening of the die-molding mold for press-molding the vitrified tiles or on the already pressed tile blanks or on a special container (FIG. 5), the orifice of one set presenting the shape of a number of dark green colored masses of natural marble and the orifice of the other set presenting the shape of grayish white chain-veins of natural marble.

There are four kinds of methods to carry out this process. In the first method, two or more than two difference colored pastes 1 and 2 (such as dark green and grayish white) contained in separate containers are filled by means of pressing technique through specially shaped die orifice (FIG. 4) directly into the frame opening of the die-stamping mold for vitrified tile blank to be directly formed, dried, sintered to become a stereo ceramic granite and marble of the first embodiment of the present invention.

Figure 4:
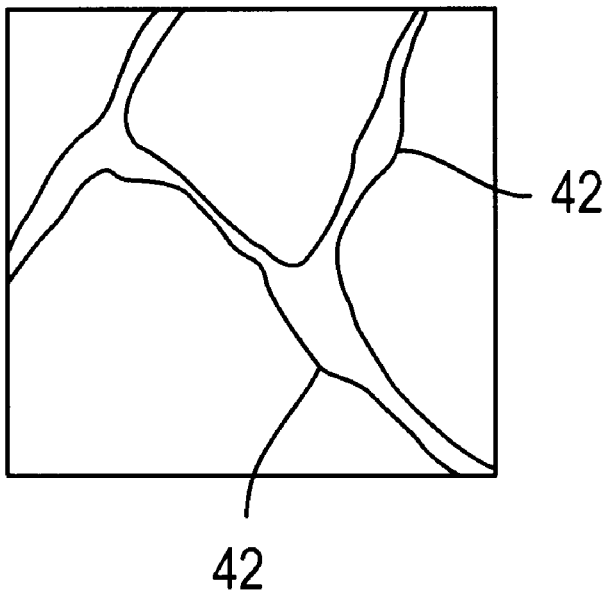
FIG. 4 is a plan diagrammatic view of the die orifice of the composite mold of the first embodiment of the present invention.
Figure 5:
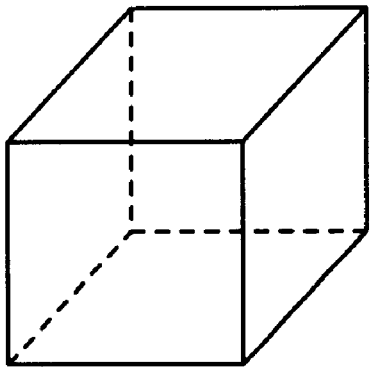
FIG. 5 is a diagrammatic view of the inner frame of the special container of the first embodiment of the present invention.
Figure 6:
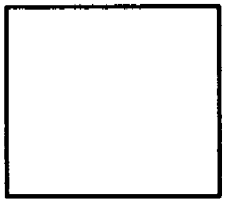
FIG. 6 is a diagrammatic view of the horizontal cutting face of the inner frame of the special container of the first embodiment.

In the second method, two or more than two different colored pastes of half-dried powder contained in separate containers are filled by pressing technique through specially shaped die orifice 42 (FIG. 4) into special container (FIG. 5).

Then the dark green ceramic material (containing more than 50% ceramic material of high melting point) and grayish white ceramic material (containing more than 60% crystalline ceramic material) in the container are composed on a plane of a certain direction into blank pieces or green body in a certain natural stone slab patterned container (FIG. 5), and cut in a certain direction into 3 mm–15 mm thick thin slips to be placed into the vitrified tile blank die-molding mold frame (FIG. 3 and 7) and pressed on a presser into vitrified tile blanks. After being baked to be dry and sintered at about 1220° C. in a vitrified tile kiln, imitation dark green marble stereo ceramic marble is produced.

In the third method, by means of sifting or pressing or stirring technology or free falling technology, the half-dried powdered material of two or more than two different colors (dark green and grayish white) contained in the container is made passing through the die orifice (FIG. 4), or is directly sifted or pressed or stirred or freely fallen into the vitrified tile die-molding mold frame from the container, to be directly pressed into a certain form, and baked to dry and sintered to be a finished product. The crucial difference between this method and the prior art sieving method of forming a pattern lies in that the prior art method sifts the colored pigments powder form time to time, while the present method sifts out many kinds of colored pigments powder only in one time, and the die orifice (FIG. 7) can project from the sieve (FIG. 7) 1 mm–30 mm in compliance to the requirement of the pattern, or it is also possible for the die orifice 42 not to project. It is possible to adopt the falling, pressing technology without the use of sieve 52 to ensure that the needed color pigment powder of different color region does not overlap or pile up, that the pattern of the product of the present invention is precise and accurate, and that the extension lines of the boundary of the symmetrical color regions of the section surrounded by the die orifice required by the pattern are essentially parallel, while the error of unparallelism is less than an angle of 40° . Even if because of the material distribution or the mold pressing act on the rear segments of the two boundary lines of the pattern color regions seen form the vertical section of the product, deformed in an unparalleled state, this at most occupies only 50% of the overall length of the vertical section boundary line.

In the fourth method, by means of sifting or pressing technology, the half-dried powdered pigment material of two or more than two different colors (dark green and grayish white) contained in the container is passed through the die orifice 42 (FIG. 3, 4, and 7) and is directly sifted or pressed on the vitrified tile blank or the already directly sintered vitrified tile body, or on tile blank already having a certain convex and concave pattern pressed out by the convex and concave mold plate or directly sintered vitrified tile body. And finally it becomes an end product after sintering.

To increase the richness of the pattern, the above-mentioned tile blank or tile body may be the middle-product (or green product) tile blank or the sintered tile body made by the above-mentioned first, second and the third methods already having the characteristics of stereo imitation granite and marble pattern.

By the above-mentioned four methods, it is possible to change the pattern of two colors to pattern of 2–100 colors (such as, white, red, yellow, blue, green, white, transparent with no color and transparent with colors). It is possible to change each color region from mono-color to complex colors and mixed colors to make vitrified tile pattern more magnificent and more luxuriant in color and have the same or even better decorative effect than real stone slab (for example, to be incorporated into ceramic tile pattern, rug pattern and fresco pattern etc.)

The product of the present invention is characterized in that it comprises stereo geometrical patterns having a thickness. It is possible to make the area of a color mars of the pattern as large as 1 $mm^2$–0.5 $mm^2$ or even more, just as the color mass of the genuine marble. It is also possible to make the material surface as rugged as rough granite or as smooth as a polished plane. The stereo-geometrical patterns composed by various back of the tile blank to 1000 mm and may extend only 0.1–2 mm, the remaining portion being composed of any other ceramic powder to reduce the cost. The area of the product of the present invention may be from as small as 42 $cm^2$ as the mosaic to as large as 30 $m^2$ as the granite slab, and the thickness may be 5 mm–1000 mm. Their overall geometrical shape may be, for example, cylindrical, partly cylindrical, spherical, polyhedral circular, bar-like, square, etc.

In the above manufacturing process, it is also possible to constitute separate or mixed color regions with such transparent or non-transparent material as quarts glass lumps, natural granite granules of various colors and ceramic linker clews. In combination with the various color regions of the present invention, the product may have better physical and chemical properties and richer coloring effect.

To facilitate mounting, it can be formed on the back of the product 20–50 mounting holes with a depth of 2–30 mm.

Figure 8:
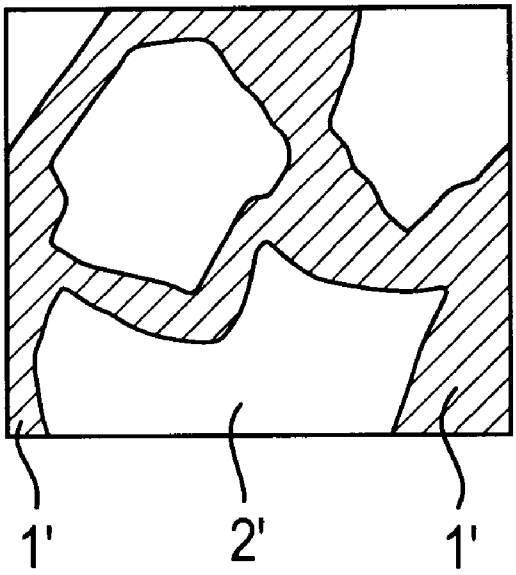
FIG. 8 is a plan diagrammatic view of the imitation white marble large veined pattern of the second embodiment of the present invention.
Figure 9:
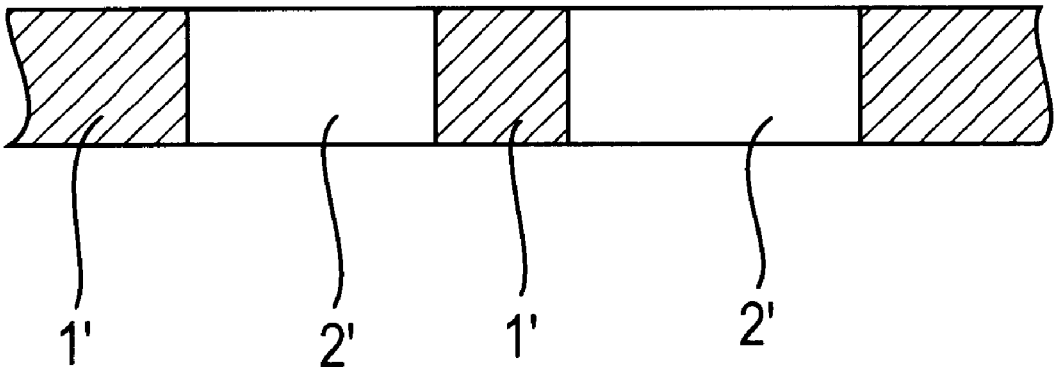
FIG. 9 is a vertical sectional view of the product of the second embodiment of the present invention.

The second embodiment of the present invention will be described with reference to FIGS. 8 and 9. It can be seen from FIG. 8 that the imitative large veined marble pattern is composed of grayish black vitrified tile mass (slanting lines portion) 1' and grayish white vitrified tile mass (white colored portion) 2'.

Figure 3:
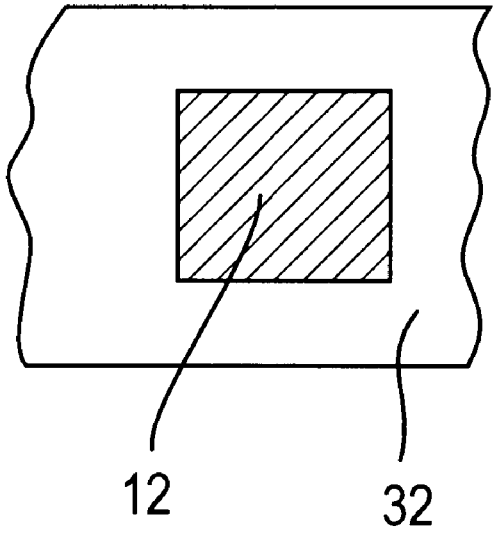
FIG. 3 is plan diagrammatic view of the lower mold frame opening of the vitrified tile die-molding (die-damping) mold of the first embodiment, wherein the shade lines 12 denotes a depression having a depth in the frame for placing ceramic material, white-colored part 32 denotes the upper surface of the lower mold of the die-molding mold.
Figure 7:
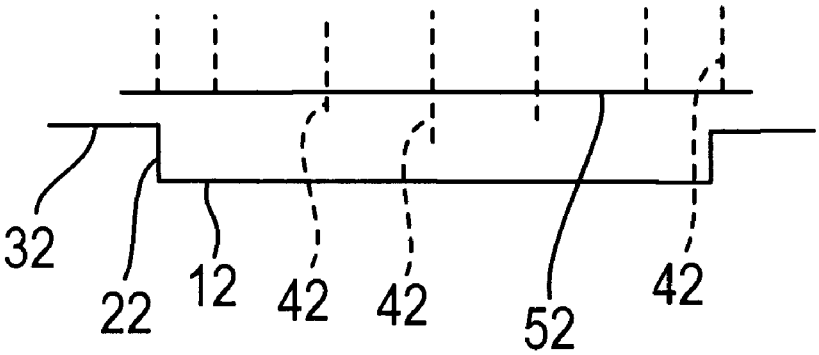
FIG. 7 is a vertical sectional diagrammatic view of the lower mold frame of the vitrified tile die-molding mold and the die orifice of the built-up mold of the first embodiment upon charging wherein reference numeral 12 denotes the bottom surface of the depression of the lower mold frame of the die-molding mold; numeral 22 denotes the vertical wall face of the depression of the lower mold frame of the die-molding mold; numeral 32 denotes the upper surface of the upper mold of the die-molding mold; and the dotted lines portion 42 denotes the die orifice portion of the built-up denotes the die orifice portion of the built-up mold, when sifting, the die orifice 42 extends already beyond the sieve 52 level by 1 mm–15 mm.

The second embodiment of the present invention is carried out in the following method. The grayish black vitrified tile powder materials (containing more than 50% ceramic material melting point of which is higher than 1250° C.) are formed as paste or half-dried powder material and are filled into a container (FIG. 5). Then the dry lump material or compressed lump material made of grayish white vitrified tile material (containing 80% ceramic material, the milting point of which is higher than 1250° C.) is crushed into small lumps and charged into a special container (FIG. 5), then pressed and cut into strips of 3 mm–30 mm thick, charged to the presser to be pressed into vitrified tile blanks in the mold frame (FIG. 3, 4, and 7). The blanks, after being baked dry, are sintered in a vitrified tile kiln at around 1220° C., and then ground and polished to obtain the finished vitrified tile with imitation large veined marble pattern.

In the various methods of the above-mentioned two embodiments, it is also possible to add at first a certain amount of monocolour powder material in the vitrified tile mold frame (FIG. 3), then the blank piece of the imitation stone slab vitrified tile having the geometrical stereo structural pattern of the present invention is placed on the mold frame, or according to the method of the first embodiment, the powder material of the stereo pattern is placed on the upper part of the mold frame and pressed for forming, then sintered to become a product. After grounding and polishing, the end product of stereo ceramic granite marble is obtained, in its vertical section, the upper layer being a pattern having certain stereo structure and the lower layer being the ordinary ceramic material. In this embodiment, since less color pigment powder is used, the cost will certainly be reduced.

Figure 10:
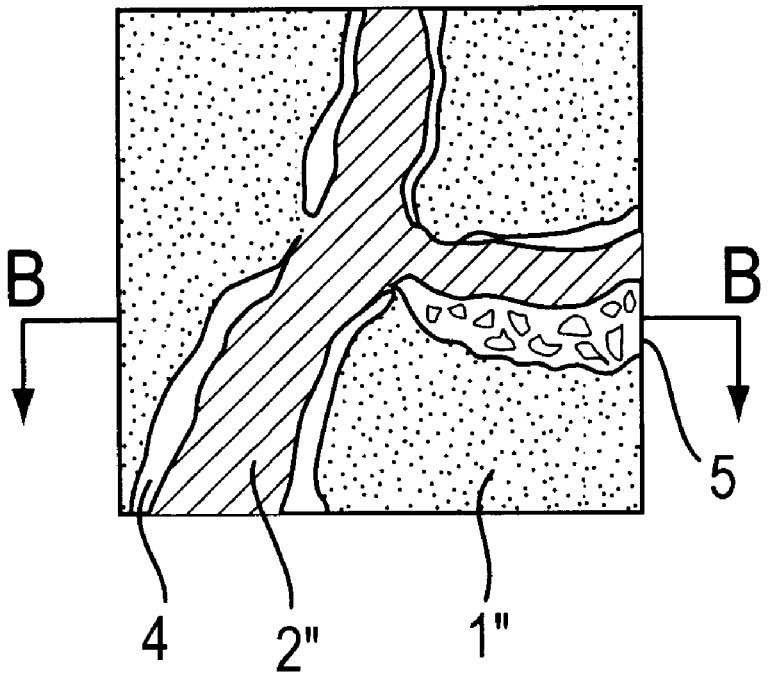
FIGS. 10 is the plan diagrammatic view of the stereo ceramic granite and marble vitrified tile with an optical grating of the third embodiment of the present invention.
Figure 11:
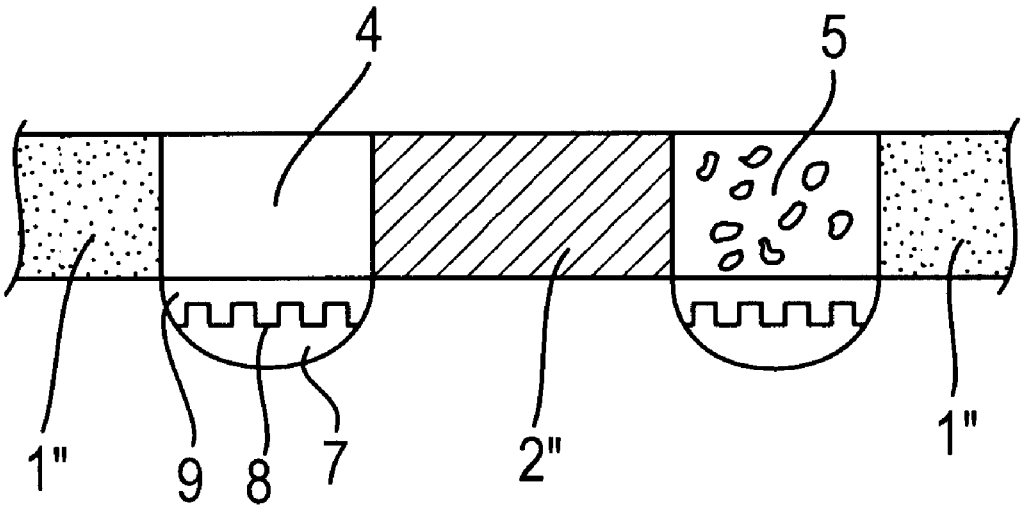
FIG. 11 is the vertical section (B—B) view of the stereo ceramic granite and marble of FIG. 10.

FIGS. 10 and 11 show respectively the plan view and vertical sectional view of the stereo imitation granite and marble vitrified tile with optical grating of the third embodiment of the present invention, wherein the dotted portion 1" denotes the dark green vitrified ceramic mass (containing 55% ceramic material, the melting point of which is higher than 1250° C.), the slanting lines portion 2" denotes the grayish white vitrified ceramic mass (containing 50% ceramic material, the melting point of which is higher than 1250° C., having non-silicate composition of gray penetrating pigment material), the white color portion 4 denotes the transparent layer of vitrified glaze, reference numeral 9 denotes the transparent acrylic resin or inorganic transparent material with optical grating relief, reference numeral 8 denotes a metal reflective layer and reference numeral 7 denotes the epoxy resin protective layer. The circular rings portion 5 is the vitrified material layer in which a non-silicate, non-transparent penetrating gray, green pigments has been added.

The manufacturing process of the product of this embodiment is as follows. In the grayish white glaze material of the product of the above-mentioned embodiment, a certain amount of transparent, high temperature, glass powder glaze material is added. When the product is manufactured in accordance with the method of the first embodiment, the transparent high temperature glass glaze portion on its backside is coated with a layer of transparent resin or transparent inorganic material, such as epoxy resin, polyurethane, melamine resin, acrylic resin or water glass low melting-point glass etc. on which a layer of optical grating membrane is pressed, so that when photosensitive technique or room-temperature heat melting or heating solidifying technique is employed, the resin layer of transparent inorganic material layer gets an optical grain relief. Then a metallic coating of , for example, aluminum, nickel, titanium, chromium, copper, gold, iron, silver, zinc and tin, or their alloys is coated, together with an additional protective layer of epoxy resin, polyurethane, and melamine resin. Finally, a stereo ceramic optical grating granite and marble with optical grating characteristic of the second embodiment of the present invention is obtained. The pattern shape of the high temperature transparent glass glaze (the temperature can reach 700° C.–1500° C.) of this embodiment can be designed to be in the shape of spot, block or stripe.

In this embodiment, it is also possible to treat the back of the product wholly with a layer of transparent resin (such as epoxy resin, polyurethane, melamine resin, acrylic resin) of optical grating relief having a metallic reflective layer, and plus a protective layer.

In the third embodiment, the grayish white penetrating pigment is added to the grayish white vitrified tile material mass, it will bring a much richer presentation to the product of the present invention. When non-transparent grayish green penetrating pigment is added to the layer containing more than 20% non-vitrified material, it will also bring the same effect. Hence, further penetrating pigments of red, black and blue color etc. can also be added in.

In practice, it is also possible to take the basic pattern formed by the above-mentioned structure as a basis, and add to it the prior art penetrating glaze partial pattern or large granule partial pattern to form a more complicated pattern. It is also possible to change the composition, quantity, dimension, thickness, shape and tone of the color mass, and provide mounting holes to facilitate the mounting. In carrying out the stereo ceramic granite and marble technology, the die orifice of the die set is made in accordance with the requirement of the pattern, as compared with that of the unsintered tile blank having the stereo ceramic granite or marble pattern made by the presser for ceramic tile, the boundary lines of the patterns of at least over three colors with more than 2 pieces in one color, are identical with the shape of the die orifice of the die set.

It should be appreciated that the scope of the present invention need not be limited to the particular scope of the embodiments described above.

What is claimed is:

1. A decorative, ceramic, imitation stone material selected from the group consisting of imitation marble and imitation granite comprising a geometrical stereo pattern formed by a non-transparent colored silicate mass material composed of silicates containing more than 20% of a non-vitreous state component and more than 20% of a vitreous state component, the colored silicate mass material having at least two different colors or special mixed colors or composition colors, wherein in a vertical section view, a product is composed of a number of colored masses; and in a microscopic view, it presents a plurality of boundary lines at the junctures of the colored masses comprised of non-vitrified and vitrified state ceramic granules of different meshes, each more than 15 mm long, the boundary lines being essentially straight lines, at least three boundary lines extending on the product plane to the edge of the product, wherein there are at least four colored masses connected to each other, in the vertical section view, the boundary lines of each of the colored masses extending parallel within 3 mm from the surface of the product, and form an angle of 10° to 170° with respect to the surface plane of the product, the deviation error of parallelism being less than 40°.

2. The decorative, ceramic, imitation stone material according to claim 1, wherein the colored silicate mass material includes at least three different colors or special mixed colors or composition colors.

3. The decorative, ceramic, imitation stone material according to claim 1, wherein there are at least five colored silicate masses connected to each other, in the vertical section view, the boundary lines of each of the colored silicate masses extend parallel within 3 mm from the surface of the product, and form a nearly perpendicular state in respect to the surface plane of the product, the deviation error of parallelism being less than 20°.

4. The decorative, ceramic, imitation stone material according to claim 1, wherein the silicates containing more than 20% of a non-vitreous component are composed of granules or lumps of 150-5 meshes or of a diameter of more than 1 mm and having a melting point of higher than 1250°.

5. The decorative, ceramic, imitation stone material according to claim 1, wherein the silicates containing more than 20% of a non-vitreous component are of crystalline state.

6. The decorative, ceramic, imitation stone material according to claim 1, wherein the area of a colored mass of said pattern is 1 $mm^2$ as granite to 0.5 $mm^2$ as marble, and the number of colored silicate masses in various color regions is from 20 to 10,000.

7. The decorative, ceramic, imitation stone material according to claim 1, wherein the pattern is composed of colored silicate masses in vitreous state having colors selected from the group consisting of red, yellow, blue, white, black and green, and glazing colors selected from the group consisting of red, yellow, green, gray, blue and silver; having metallic glazing luster; or having a pattern comprised of colored glaze and crystalline glaze selected from the group consisting of red, blue, black, yellow, white, purple and green colors, having a melting point lower than those of other ingredients of the product.

8. The decorative, ceramic, imitation stone material according to claim 1, wherein a vitrified tile of said imitation stone material has a surface that is as rugged as that of rough granite or as smooth as a polished plane surface.

9. The decorative, ceramic, imitation stone material according to claim 1, wherein the geometrical stereo pattern comprises various colored masses extending downward from the surface as deep as 3–1000 mm, or only extending 0.1–3 mm, the remainder being composed of other ceramic powder material of any colors, whereas the vertical boundary lines of the colored masses are either parallel, with an error less than 40 degrees, or unparallel.

10. The decorative, ceramic, imitation stone material according to claim 1, wherein the imitation stone material has an area from 4 $cm^2$ as a mosaic to 30 $m^2$ as a large granite slab, and the thickness is 500–1000 mm, wherein an overall geometrical shape is selected from the group consisting of cylindrical, plate with arched face, partly cylindrical, spherical, polyhedral, circular, bar and square.

11. The decorative, ceramic, imitation stone material according to claim 1, further comprising a gap between the non-transparent ceramic masses in the pattern composed of masses of different color and a high temperature vitrified ceramic glaze present in said gap, said high temperature vitrified ceramic glaze having a melting temperature of 700–1500° C., and being transparent with no color or transparent with colors forming a local structure of spots, blocks or stripes.

12. The decorative, ceramic, imitation stone material according to claim 1, wherein the silicate ceramic material containing more than 20% of a non-vitreous component comprises more than one clear transparent mass selected from the group consisting of blue, gray, yellow and red clear transparent masses comprising a permeating pigment composition containing a non-silicate component.

13. The decorative, ceramic, imitation stone material according to claim 1, wherein a region of the vitreous component comprises more than one mass selected from the group consisting of blue, gray, black, green, red and yellow masses comprising a permeating pigment composition containing a non-silicate component.

14. The decorative, ceramic, imitation stone material according to claim 1, wherein said pattern composed of silicates of various colors contains more than 20% non-vitreous components, and comprises a pattern with material selected from the group consisting of quartz, glass, lumps and granules of natural granite having various colors of ceramic clinker clew mixed together, or a pattern individually mixed with a ceramic powder material.

15. The decorative, ceramic, imitation stone material according to claim 1, further comprising an optical grating relief transparent resin layer comprising a metal reflexive layer and a protective layer applied on an entire back side of said imitation stone material.

16. The decorative, ceramic, imitation stone material according to claim 1, comprising 2–50 mounting holes having a depth of 2–30 mm formed on a backside or lateral side of said imitation stone material to facilitate mounting.

* * * * *